US005837410A

United States Patent [19]

Nakamura et al.

[11] Patent Number: 5,837,410

[45] Date of Patent: Nov. 17, 1998

[54] PHOTOCONDUCTOR FOR ELECTROPHOTOGRAPHY

[75] Inventors: Yoichi Nakamura; Shinichiro Nishimaki, both of Nagano, Japan

[73] Assignee: Fuji Electric Co., Ltd., Kawasaki, Japan

[21] Appl. No.: 715,850

[22] Filed: Sep. 19, 1996

[30] Foreign Application Priority Data

Sep. 20, 1995 [JP] Japan ..... 7-241173

[51] Int. Cl.[6] ..... G03G 5/06; G03G 5/14

[52] U.S. Cl. ..... 430/58; 430/130; 399/159

[58] Field of Search ..... 430/58, 130, 131, 430/132, 133; 399/159

[56] References Cited

U.S. PATENT DOCUMENTS 4,543,314 9/1985 Maxwell ..... 430/135

5,422,211 6/1995 Law et al. ..... 430/59

5,550,000 8/1996 Takegawa et al. ..... 430/130

*Primary Examiner*—John Goodrow

*Attorney, Agent, or Firm*—Morrison Law Firm

[57] ABSTRACT

A photoconductor for electrophotography includes a conductive substrate and an organic film comprised of one or more layers which contain one or more organic compounds. The water content of the organic film is regulated to be within 0.02 to 5.0 weight percent with respect to the total weight of the organic film by exposing the photoconductor to an atmosphere of controlled temperature and humidity during fabrication of the photoconductor. By exposing the photoconductor to the controlled atmosphere, consistency in photoconductive properties is realized from one photoconductor to another.

9 Claims, 1 Drawing Sheet

PHOTOCONDUCTOR FOR ELECTROPHOTOGRAPHY

BACKGROUND OF THE INVENTION

The present invention relates to a photoconductor for electrophotography. More specifically, the present invention relates to a photoconductor including a conductive substrate and an organic film which includes one or more layers including one or more organic compounds. A water content of the organic film is regulated by exposing the photoconductor to an atmosphere of controlled temperature and humidity.

In the prior art, organic photoconductors include a photoconductive layer which contains one or more organic photoconductive materials. The photoconductive layer is formed on a conductive substrate. Usually, the photoconductive layer is formed by coating the conductive substrate with coating liquid including one or more organic photoconductive materials dispersed and dissolved into an organic solvent. The coating liquid is then dried on the conductive substrate. A binder resin is added to the organic solvent, if necessary. The photoconductive layer is either a single layer or a multi-layer laminate. a multi-layer photoconductive layer includes a charge generation layer and a charge transport layer. An undercoating layer is optionally interposed between the substrate and the photoconductive layer. A protection layer is optionally laminated on the photoconductive layer. Usually, these optional layers are formed as resin coating films. Organic compounds such as a curing agent, an antioxidant, or an ultraviolet ray absorbing agent may be added to the photoconductive layer, undercoating layer, and the protection layer when it is necessary or advantageous.

Organic compounds used in the organic photoconductor for electrophotography include: anthracene compounds (Japanese Unexamined Laid Open Patent Applications (Koukai, herein after referred to as "JUA") No. H04-358157 and H05-333574); oxadiazole compounds (JUA No. H06-135951); triazole compounds (JUA No. H05-224444); imidazolone compounds (JUA No. H02-165155); imidazole compounds (JUA No. H05-257305); oxazole compounds (JUA No. H05-150483); imidazolidine compounds (Japanese Examined Patent Application (Koukoku, herein after referred to as "JEA") No. S35-11217); pyrazoline compounds (JUA No. H04-194863); benzothiazole compounds (JUA No. H05-323636); triphenylamine compounds (JUA No. H05-323635); benzoxazole compounds (JUA No. H04-233548); poly(vinylcarbazole) compounds (JUA No. H05-72751); and polyvinyl compounds (U.S. Pat. No. 3,162,532.

Organic compounds used in the organic photoconductor for electrophotography also include: phthalocyanine compounds (JUA No. H06-202350); azo compounds (JEA No. H05-29108 and JUA No. H06-80895); triphenylmethane compounds (European Patent No. 605145); hydrazone compounds (JEA No. H05-24507 and JUA No. H06-89040); and triarylamine compounds (JUA's No. H05-232721 and H06-101119).

Triamine compounds (JUA No. H05-127403), N-phenylcarbazole compounds (JUA No. H02-207262), stilbene compounds (JUA No. H06-161118), and butadiene compounds (JUA No. H06-75387) are also used.

Polyamide resins (JUA No. H06-186767), polyurethane resins (JUA No. H05-158266), and epoxy resins (JUA No. H06-75387) are used as the binders for the undercoating and protection layers.

Manufacturing methods for these organic photoconductors are disclosed in JUA's No. S59-60441, S61-18964, S61-20044, S61-25149, S61-39048, and H02-126959.

As evidenced by the examples above, many types of organic materials are used for organic photoconductors. The specific type of organic material used depends on the application of the apparatus in which the organic photoconductor is installed. The various organic photoconductors are manufactured by various methods. However, even photoconductors which are manufactured by the same method, using the same materials, produce inconsistent image quality from one photoconductor to another. These variations in image quality are the result of variations in the photoconductive properties of each photoconductor, especially the electrical properties.

OBJECTS AND SUMMARY OF THE INVENTION

It is an object of the present invention to provide an organic photoconductor which overcomes the drawbacks in the prior art.

It is a further object of the present invention to provide a photoconductor for electrophotography in which the photoconductive properties are consistent from one photoconductor to another when using the same method and the same materials to manufacture the photoconductor.

It is still a further object of the present invention to provide a photoconductor for electrophotography in which consistent photoconductive properties are achieved by exposing the photoconductor to an atmosphere of controlled temperature and humidity to regulate the water content of the organic film with respect to the total weight of the organic film.

Briefly stated, a photoconductor for electrophotography includes a conductive substrate and an organic film of one or more layers which contain one or more organic compounds. The water content of the organic film is regulated to be within 0.02 to 5.0 weight percent with respect to the total weight of the organic film by exposing the photoconductor to an atmosphere of controlled temperature and humidity during manufacturing of the photoconductor. By exposing the photoconductor to the controlled atmosphere, consistency in photoconductive properties is realized from one photoconductor to another.

The water content of an organic film affects the transport of charged carriers. By limiting the water content of the organic film to within the above prescribed range, the manufacturing method and the materials are effectively utilized to consistently realize the desirable properties of the photoconductor.

According to an embodiment of the present invention, there is disclosed, a photoconductor apparatus including a conductive substrate, an organic film on the conductive substrate, the organic film including an organic photoconductive material and the photoconductor being exposed to an atmosphere of a controlled temperature and humidity to regulate a water content of the organic film.

According to another embodiment of the present invention, there is disclosed, a process for making a photoconductor including the steps of forming a conductive substrate, mixing at least one organic photoconductor material with a binder material, coating the organic photoconductor material in the binder material on a surface of the conductive substrate to form an organic film, drying the organic film and exposing the organic film to an atmosphere of controlled temperature and humidity effective to produce a predetermined water content in the organic film.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT(S)

Figure 1:
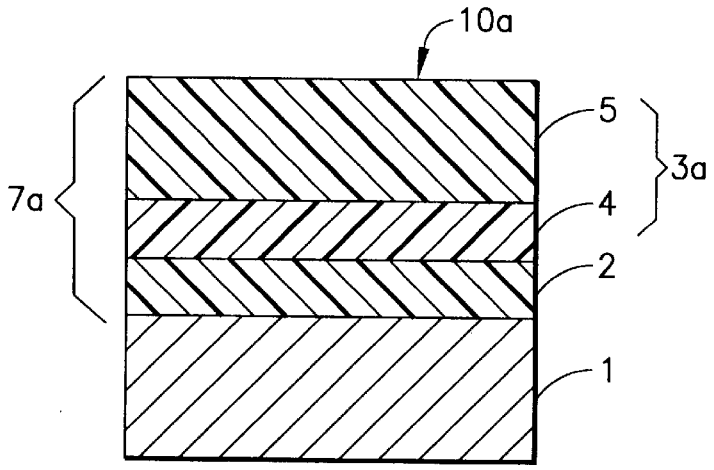
FIG. 1 is a cross section of a photoconductor laminate for negative charging.

Referring now to FIG. 1, a photoconductor laminate 10*a* for negative charging includes a conductive substrate 1 having deposited thereon a multi-layered organic film 7*a*. Organic film 7*a* includes an undercoating layer 2 on substrate 1. Undercoating layer 2 is a resin. A photoconductive layer 3*a* is deposited on undercoating layer 2. Photoconductive layer 3*a* includes a charge generation layer 4 on undercoating layer 2, and a charge transport layer 5 on charge generation layer 4.

Figure 2:
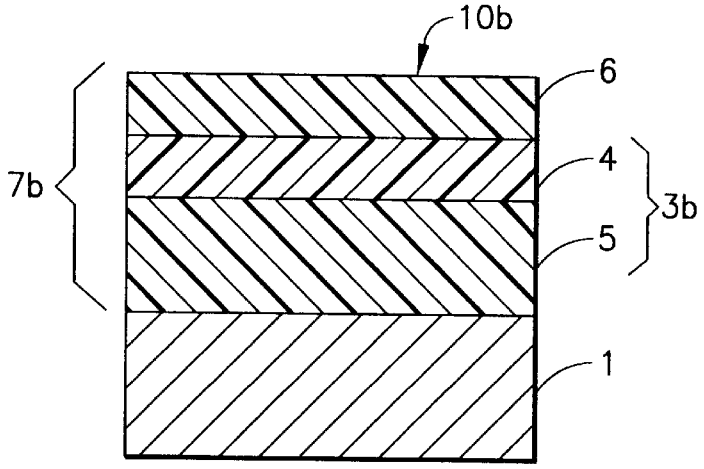
FIG. 2 is a cross section of a photoconductor laminate for positive charging.

Referring now to FIG. 2, a photoconductor laminate 10*b* for positive charging includes a conductive substrate 1, a photoconductive layer 3*b* on substrate 1, and a protection layer 6 on the photoconductive layer 3*b*. Photoconductive layer 3*b* includes a charge transport layer 5 on conductive substrate 1, and a charge generation layer 4 on charge transport layer 5. Charge generation layer 4 includes an organic charge generating agent and a binder resin as its main components. Charge transport layer 5 includes an organic charge transport agent and a binder resin as its main components. In this embodiment, an organic film 7*b* includes charge transport layer 5, charge generation layer 4, and protection layer 6.

Figure 3:
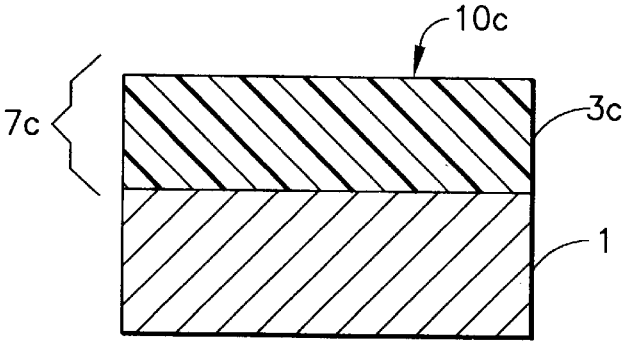
FIG. 3 is a cross section of a photoconductor laminate for positive charging.

Referring now to FIG. 3, a photoconductor laminate 10*c* for positive charging includes a conductive substrate 1 and a single layered photoconductive layer 3*c* on substrate 1. Single layered photoconductive layer 3*c* contains photoconductive materials as its main components. In this embodiment, an organic film 7*c* is single layered photoconductive layer 3*c*.

Referring now to FIGS. 1–3, these photo conductor laminates 10*a–c* are exposed to an atmosphere of controlled temperature and humidity. The temperature and humidity of the atmosphere are regulated to adjust the total water content in all the organic layers between the range of 0.02 and 5.0 weight percent with respect to the total weight of the organic film. After exposure to the controlled atmosphere, the constituent layers were peeled off to verify the water content in each layer. The water content of each layer was measured with a Karl Fisher moisture meter (MKA-3p supplied by Kyoto Electronics Industries, Ltd.).

Conductive substrate 1 is made from drums, plates, or sheets of a metal. The metal is aluminum, copper, nickel, iron, or an alloy of these metals. As an alternative, conductive substrate 1 can also be made from an electrically conductive resin. As another alternative, conductive substrate 1 can also be made from drums, plates, and sheets which are rendered conductive by laminating a conductive sheet thereon. The conductive sheet is produced by depositing a metal film on conductive substrate 1, or by coating conductive substrate 1 with a conductive paint.

Undercoating layer 2 is a coating liquid which contains, as its main component, soluble polyamide, casein, poly (vinyl alcohol), melamine, cellulose, urethane, polythiophene, polypyrrole or polyaniline. Undercoating layer 2 is from 0.1 to 20 micrometers in thickness.

Charge generation layer 4 is a coating liquid in which a charge generating agent is dissolved with a resin binder. A phthalocyanine pigment, azo pigment, anthanthrone pigment, perylene pigment, perynone pigment, squalane pigment, thiapyrylium pigment, and quinacridone pigment are exemplary of the charge generating agents which can be used. A poly(vinyl butyral) resin, poly(vinyl chloride) copolymer resin, acrylic resin, polyester resin and polycarbonate resin are resin binders of the charge generation layer. Charge generation layer 4 is from 0.1 to 5 micrometers in thickness.

Charge transport layer 5 is a coating liquid in which a charge transport agent is dissolved with a resin binder. An enamine compound, styryl compound, hydrazone compound, and amine compound are exemplary of the charge transport agents. A polyester resin, polycarbonate resin, polymethacrylate resin, and polystyrene resin are binder resins of the charge transport layer. Charge transport layer 5 is from 10 to 40 micrometers in thickness.

Protection layer 6 is a coating liquid into which a soluble polyamide resin, melamine resin, epoxy resin, silicone resin, and organosiloxane resin are dissolved or dispersed.

Undercoating layer 2, photoconductive layer 3*a–c*, and protection layer 6 may be doped with an antioxidizing agent and/or an ultraviolet ray absorbing agent as desired.

1st through 5th Embodiments and Comparative Examples 1 & 2

A coating liquid for undercoating layer 2 of the 1st through 5th embodiments and comparative examples 1 and 2 is prepared by mixing 70 weight parts of polyamide resin (Amilan CM 8000 supplied from TORAY INDUSTRIES, INC.) and 930 weight parts of methanol (supplied from Wako Pure Chemical Industries, Ltd.) in a mixer. Undercoating layer 2 is applied to substrate 1 made of aluminum by dip-coating. Undercoating layer is subsequently dried to form an undercoating layer of 0.5 micrometers in thickness.

A coating liquid for the charge generation layer 4 is prepared by mixing 10 weight parts of metal-free phthalocyanine (Fastgen Blue 8120 B supplied from DAINIPPON INK & CHEMICALS, INC.), 10 weight parts of a vinylchloride resin (MR-110 supplied from Nippon Zeon Co., Ltd.), 686 weight parts of dichloromethane (supplied from Wako Pure Chemicals Co., Ltd.), and 294 weight parts of 1,2-dichloroethane (supplied from Wako Pure Chemical Industries, Ltd.) in a mixer, and then dispersing these reagents in an ultrasonic dispersing machine. Charge generation layer 4 is applied by dip-coating the coating liquid on undercoating layer 2. The coating liquid is subsequently dried to form charge generation layer 4 of 0.5 micrometers in thickness.

A coating liquid for charge transport layer 5 is prepared by mixing 100 weight parts of 4-(diphenylamino)benzaldehyde phenyl(2-thienylmethyl)hydrazone (synthesized in Fuji Electric Co., Ltd.), which is represented by the following formula,

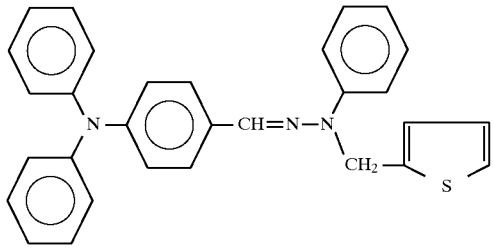

100 weight parts of polycarbonate resin (Panlite K-1300 supplied from TEIJIN CHEMICAL LTD.), 800 weight parts of tetrahydrofuran (supplied from Wako Pure Chemical Industries, Ltd.), and 1 weight part of silane coupling agent (KP-340 supplied Shin-Etsu Chemical Co., Ltd.) in a mixer. The coating liquid is coated on charge generation layer 4 by dip-coating and subsequently dried to form a charge transport layer of 20 micrometers in thickness.

Finally, fabrication of the photoconductors of the 1st through 5th embodiments and comparative examples 1 and 2 is finished by exposing the formed laminates to a controlled atmosphere. The temperatures and humidity of the controlled atmosphere are regulated such that the water content of the laminates is as listed below in Table 1.

The electrical properties of the fabricated photoconductors are evaluated in an electrostatic recording paper test machine (SP-428 supplied from Kawaguchi Electric Works Co., Ltd.). The photoconductor surfaces are charged up in a dark place to −600 V by corona discharge at −5 kV. The photoconductor surfaces are then exposed for one second to a laser beam of 780 nm in wavelength and 1 $\mu W/cm^2$ in intensity, and white potential $V_W$ (the potential of the surface of the photoconductor after the surface is exposed to light) is measured.

The photoconductors are mounted on a laser printer (Laser Jet III supplied from Hewlett-Packard Co.) and printing tests are conducted. The results are listed in Table 1.

TABLE 1

| Photoconductors | Water content (weight %) | White Potential (V) | Printing quality |
|---|---|---|---|
| 1st Embodiment | 0.02 | −100 | Good |
| 2nd Embodiment | 0.5 | −95 | Good |
| 3rd Embodiment | 1.0 | −88 | Good |
| 4th Embodiment | 2.0 | −80 | Good |
| 5th Embodiment | 5.0 | −75 | Good |
| Comparative 1 | 0.01 | −152 | Thin letter |
| Comparative 2 | 5.5 | −26 | Thick letter |

As Table 1 indicates, the absolute value of the white potential reduces with increasing water content. The reasons why the white potential varies so greatly with small variation of the water content, in comparing the 1st embodiment with comparative example 1 and the 5th embodiment with comparative example 2, are not yet understood. The evaluation of the photoconductors in terms of printing quality reveals that comparative examples 1 and 2 have problems with their print quality. Therefore, the results shown in Table 1 indicate that the preferable water content for obtaining an excellent photoconductor is within the range between 0.02 and 5.0 weight percent with respect to the total weight of the organic film.

6th through 10th Embodiments and Comparative Examples 3 & 4

A coating liquid for a charge generation layer 4 of the 6th through 10th embodiments and comparative examples 3 and 4 is prepared by mixing 10 weight parts of titanyl phthalocyanine (synthesized in Fuji Electric Co., Ltd.), which is represented by the following formula,

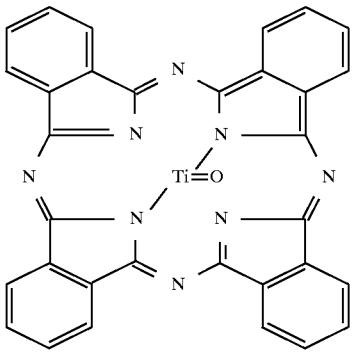

10 weight parts of poly(vinyl butyral) resin (S.LEC BM-2 supplied from Sekisui Chemical Co., Ltd.), and 980 weight parts of tetrahydrofuran (supplied from Wako Pure Chemical Industries, Ltd.) in a mixer, and then dispersing these reagents in an ultrasonic dispersing machine. Except for the coating liquid for the charge generation layer 4, the photoconductors of the 6th through 10th embodiments and comparative examples 3 and 4 are prepared in the same manner as the photoconductors of the 1st through 5th embodiments and comparative examples 1 and 2. The photoconductors of the 6th through 10th embodiments and comparative examples 3 and 4 are evaluated in the same manner as the photoconductors of the 1st through 5th embodiments and comparative examples 1 and 2. The results are listed in Table 2.

TABLE 2

| Photoconductors | Water content (weight %) | White Potential (V) | Printing quality |
|---|---|---|---|
| 6th Embodiment | 0.02 | −85 | Good |
| 7th Embodiment | 0.5 | −81 | Good |
| 8th Embodiment | 1.0 | −72 | Good |
| 9th Embodiment | 2.0 | −66 | Good |
| 10th Embodiment | 5.0 | −61 | Good |
| Comparative 3 | 0.01 | −139 | Thin letter |
| Comparative 4 | 5.5 | −10 | Thick letter |

As Table 2 indicates, the 6th through 10th embodiments show similar results with those of the 1st through 5th embodiments. Comparative examples 3 and 4 also show similar results with those of comparative examples 1 and 2. Comparative examples 3 and 4 have similar problems with printing quality as comparative examples 1 and 2. Again, Table 2 also shows that the preferable water content for obtaining an excellent photoconductor is within the range between 0.02 and 5.0 weight percent with respect to the total weight of all the organic layers.

11th through 15th Embodiments and Comparative Examples 5 & 6

A coating liquid for a charge generation layer 4 of the 11th through 15th embodiments and comparative examples 5 and 6 is prepared by mixing 10 weight parts of 2,2'-[(3,3'-dichloro[1,1'-biphenyl]-4,4'-diyl)bis(azo)]bis[1-hydroxy-3-methyl-pyrido[1,2-a]benzimidazole-4-carbonitrile] (synthesized in Fuji Electric Co., Ltd.), which is represented by the following formula,

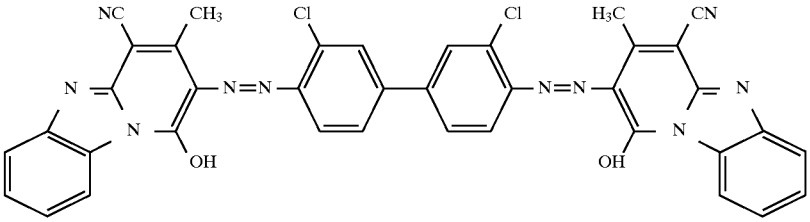

10 weight parts of poly(vinyl butyral) resin (S.LEC BM-2 supplied from Sekisui Chemical Co., Ltd.), 882 weight parts of 2-butanone (supplied from Wako Pure Chemical Industries, Ltd.), and 98 weight parts of cyclohexanone (supplied from Wako Pure Chemical Industries, Ltd.) in a mixer, and then dispersing these reagents in an ultrasonic dispersing machine. Except for the coating liquid for the charge generation layer 4, the photoconductors of the 11th through 15th embodiments and comparative examples 5 and 6 are prepared in the same manner as the photoconductors of the 1st through 5th embodiments and comparative examples 1 and 2.

The photoconductors of the 11th through 15th embodiments and comparative examples 5 and 6 are evaluated in the electrostatic recording paper test machine (SP-428 supplied from Kawaguchi Electric Works Co., Ltd.). The photoconductor surfaces are charged up in a dark place to −600 V by corona discharge at −5 kV. Then the photoconductor surfaces are exposed for one second to white light of 2 lux, and white potential $V_W$ is measured.

The same tests of these photoconductors are conducted in a plain paper copier (FP-3380 supplied from Matsushita Electric Industrial Co., Ltd.). The results are listed in Table 3.

TABLE 3

| Photoconductors | Water content (weight %) | White Potential (V) | Printing quality |
|---|---|---|---|
| 11th Embodiment | 0.02 | −50 | Good |
| 12th Embodiment | 0.5 | −44 | Good |
| 13th Embodiment | 1.0 | −39 | Good |
| 14th Embodiment | 2.0 | −35 | Good |
| 15th Embodiment | 5.0 | −31 | Good |
| Comparative 5 | 0.01 | −124 | Minute black spots |
| Comparative 6 | 5.5 | −11 | Minute white spots & faint images |

As Table 3 indicates, the 11th through 15th embodiments show similar results with those of the 1st through 5th embodiments. Comparative examples 5 and 6 also show similar results with those of comparative examples 1 and 2. Comparative examples 5 and 6 have similar problems in image quality as comparative examples 1 and 2. Again, the results shown in Table 3 reveal that the preferable water content for obtaining an excellent photoconductor is within the range between 0.02 and 5.0 weight percent with respect to the total weight of all the organic layers.

16th through 20th Embodiments and Comparative Examples 7 & 8

A coating liquid for a charge transport layer 5 of the 16th through 20th embodiments and comparative examples 7 and 8 is prepared by mixing 100 weight parts of 4,4'-bis[1-(2-methylindolyl)]biphenyl (synthesized in Fuji Electric Co., Ltd.), 100 weight parts of polycarbonate resin (Panlite K-130 supplied from TEIJIN CHEMICAL LTD.), 800 weight parts of dichloromethane (supplied from Wako Pure Chemical Industries, Ltd.), and 1 weight part of silane coupling agent (supplied from Shin-Etsu Chemical Co., Ltd.) in a mixer. Except for the coating liquid for the charge transport layer 5, the photoconductors of the 16th through 20th embodiments and comparative examples 7 and 8 are prepared in the same manner as the photoconductors of the 11th through 15th embodiments and comparative examples 6 and 7.

The photoconductors of the 16th through 20th embodiments and comparative examples 7 and 8 are evaluated in the same manner as the 11th through 15th embodiments and comparative examples 5 and 6. The results are listed in Table 4.

TABLE 4

| Photoconductors | Water content (weight %) | White Potential (V) | Printing quality |
|---|---|---|---|
| 16th Embodiment | 0.02 | −52 | Good |
| 17th Embodiment | 0.5 | −45 | Good |
| 18th Embodiment | 1.0 | −38 | Good |
| 19th Embodiment | 2.0 | −33 | Good |
| 20th Embodiment | 5.0 | −30 | Good |
| Comparative 7 | 0.01 | −127 | Minute black spots |
| Comparative 8 | 5.5 | −13 | Minute white spots & faint images |

As Table 4 indicates, the 16th through 20th embodiments show similar results with those of the 11th through 15th embodiments. Comparative examples 7 and 8 also show similar results with those of comparative examples 5 and 6. Comparative examples 7 and 8 have the same problems in image quality as comparative examples 5 and 6. Again, the results of Table 4 show that the preferable water content for obtaining an excellent photoconductor is within the range of 0.02 and 5.0 weight percent with respect to the total weight of all the organic layers.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A photoconductor apparatus comprising:

a conductive substrate;

an organic film on said conductive substrate;

said organic film having a photoconductive layer, said photoconductive layer including an organic photoconductive material; and said photoconductor being exposed to an atmosphere of a controlled temperature and humidity effective to regulate a final water content of said organic film, said final water content being from about 0.02 to about 5.0 weight percent with respect to a total weight of said organic film.

2. The photoconductor apparatus of claim 1, wherein said organic film includes:

an undercoating layer on said conductive substrate; and said photoconductive layer on said undercoating layer.

3. The photoconductor apparatus of claim 1, wherein said organic film includes:

said photoconductive layer on said conductive substrate; and a protection layer on said photoconductive layer.

4. The photoconductor apparatus of claim 1, wherein said organic film includes a charge generation layer and a charge transport layer.

5. A process for making a photoconductor comprising the steps of:

forming a conductive substrate;

mixing at least one organic photoconductor material with a binder material;

coating said organic photoconductor material in said binder material on a surface of said conductive substrate to form an organic film;

drying said organic film; and exposing said organic film to an atmosphere of controlled temperature and humidity effective to produce a predetermined final water content in said organic film, said predetermined final water content being from about 0.02 to about 5.0 weight percent with respect to a total weight of said organic film.

6. The process of claim 5, further comprising:

coating an undercoating layer on said conductive substrate; and coating said organic photoconductor on said undercoating.

7. The process of claim 5, further comprising coating a protection layer on a surface of said photoconductive layer.

8. The process of claim 5, wherein:

said step of mixing at least one organic photoconductor compound material with a binder material includes mixing a first organic compound with a first binder and mixing a second organic compound with a second binder;

said step of coating includes coating said first organic compound in said first binder on said substrate to form one of a charge generation layer and a charge transport layer and coating said second organic compound in said second binder on said first layer to form the other of a charge generation layer and a charge transport layer.

9. A photoconductor apparatus comprising:

a conductive substrate;

an organic film on said conductive substrate;

said organic film having a photoconductive layer, said photoconductive layer including an organic photoconductive material;

said photoconductor being exposed to an atmosphere of a controlled temperature and humidity during manufacturing, said atmosphere being effective to regulate a final water content of said organic film, said final water content being from about 0.02 to about 5.0 weight percent with respect to a total weight of said organic film.

* * * * *